US005976035A

United States Patent [19]

Umezawa et al.

[11] Patent Number: 5,976,035

[45] Date of Patent: Nov. 2, 1999

[54] WOUND GOLF BALL

[75] Inventors: Junji Umezawa; Shinich Kakiuchi; Yutaka Masutani; Yasushi Ichikawa, all of Chichibu, Japan

[73] Assignee: Bridgestone Sports Co., Ltd., Tokyo, Japan

[21] Appl. No.: 09/041,017

[22] Filed: Mar. 12, 1998

[30] Foreign Application Priority Data

Mar. 12, 1997 [JP] Japan ..... 9-076557

[51] Int. Cl.[6] ..... A63B 37/06; A63B 37/12

[52] U.S. Cl. ..... 473/364; 473/365

[58] Field of Search ..... 473/363, 365, 473/378, 409, 361, 364

[56] References Cited

U.S. PATENT DOCUMENTS 1,915,587 6/1933 Worthington ..... 473/363

3,177,280 4/1965 Ford et al. ..... 473/378 X 5,609,535 3/1997 Morgan ..... 473/409

5,816,942 10/1998 Hayashi et al. ..... 473/365 X

*Primary Examiner*—George J. Marlo

*Attorney, Agent, or Firm*—Sughrue, Mion, Zinn, Macpeak & Seas, PLLC

[57] ABSTRACT

A wound golf ball has a wound core enclosed with a multilayer cover. The wound core consists of a center ball and a thread rubber layer. The multilayer cover includes an inner layer, an outer layer, and an adhesive layer therebetween. The adhesive layer forms a firm joint between the cover inner and outer layers whereby the ball is improved in restitution, spin and durability. The outer cover is formed of a non-yellowing thermoplastic polyurethane. The cover outer layer is injection molded on the adhesive layer.

14 Claims, 1 Drawing Sheet

WOUND GOLF BALL

BACKGROUND OF THE INVENTION

1. Field of the Invention

This invention relates to a wound golf ball having a multilayer cover, and more particularly, to a wound golf ball which is improved in restitution, spin, and durability.

2. Prior Art

As is well known in the art, wound golf balls are superior in spin, controllability, and hitting feel compared to solid golf balls.

In the prior art, wound golf balls are manufactured by winding high stretching thread rubber around a liquid or solid center to form a thread rubber layer thereon, and enclosing the thread rubber layer with a cover of balata rubber or ionomer resin.

As compared with wound balata balls, the wound golf balls using ionomer resins as the cover stock are superior in flight distance on driver shots, but inferior in spin properties necessary for approach play on the green. On the other hand, wound balata balls are less durable, for example, in that their cover presenting the ball surface can be scuffed or fretted by bunker shots and cut when topped with iron clubs.

For the purpose of improving spin property and durability, a wound golf ball using a softer ionomer resin as the cover stock was also proposed. This ball has problems that it produces little difference in flight distance on driver shots from the wound balata balls and that it can be cut in the cover when topped with iron clubs as are the wound balata balls.

From this standpoint, the inventors proposed in JP-A 224323/1996 a new type of wound golf ball comprising a solid center and a cover of a two layer structure wherein the cover outer layer has a low hardness and the cover inner layer has a high hardness. This wound golf ball has many advantages. On approach shots, the ball is susceptible to spin and hence, improved in spin properties and controllability because the cover outer layer is soft. Because the cover inner layer has a high hardness and the cover as a whole has satisfactory restitution or resilience, the ball produces an increased initial velocity and a low spin rate on driver shots, which insures an increased flight distance. The combination of the soft outer layer and the hard inner layer provides improved cut durability. The outer layer formed of a low hardness ionomer resin is improved in scuff resistance over a balata cover and high hardness ionomer resin covers.

Such wound golf balls, however, are still desired to increase the ball bounce for increasing the flight distance and to further improve the spin performance. The balls are also desired to be so durable that the ball can be used repeated times.

SUMMARY OF THE INVENTION

An object of the present invention is to provide a wound golf ball which is further improved in restitution, spin and durability.

The invention provides a wound golf ball comprising a wound core enclosed with a multilayer cover. The wound core consists of a center ball and a thread rubber layer formed by winding thread rubber around the center ball. The multilayer cover includes an inner layer and an outer layer. According to the invention, an adhesive layer is disposed between the cover inner layer and the cover outer layer.

The wound golf ball of interest is of the type comprising a wound core consisting of a center ball and a thread rubber layer and a multilayer cover on the wound core of a multilayer structure including an inner layer and an outer layer. In the prior art, the wound golf ball of this type is manufactured by a compression molding technique, that is, by forming the wound core, mating inner and outer layers to form a pair of half cups, encasing the wound core in the pair of half cups, and compressing the half cups to the core. The junction between the cover inner and outer layers is accomplished mainly by contact bonding. This bonding mechanism leaves a durability problem outstanding because the junction between the inner and outer layers is insufficient so that restitution losses and spin losses may occur at the interface, and the ball surface will become cracked on repetitive shots.

Making investigations for preventing the restitution losses and spin losses at the interface between the cover inner and outer layers and improving the durability of the ball, the inventors have found that by interposing an adhesive between the cover inner and outer layers to tightly bond the two layers with the adhesive, the interfacial bond between the two layers is strengthened so that the ball is improved in restitution and spin and the cover becomes more resistant to cracking, that is, more durable.

The inventors have further found that by forming the cover inner layer from an ionomer resin and the cover outer layer from a non-yellowing thermoplastic polyurethane, the ball is increased in moment of inertia and then expected to travel a further distance. Better results are obtained when the cover inner layer has a Shore D hardness of 50 to 65 and a gage of 0.5 to 2.0 mm and the cover outer layer has a Shore D hardness of 35 to 55 and a gage of 0.5 to 2.5 mm. For the adhesive layer, an epoxy resin or urethane resin base adhesive is appropriate.

BRIEF DESCRIPTION OF THE DRAWINGS

The sole FIGURE.

BEST MODE FOR CARRYING OUT THE INVENTION

Figure 1:
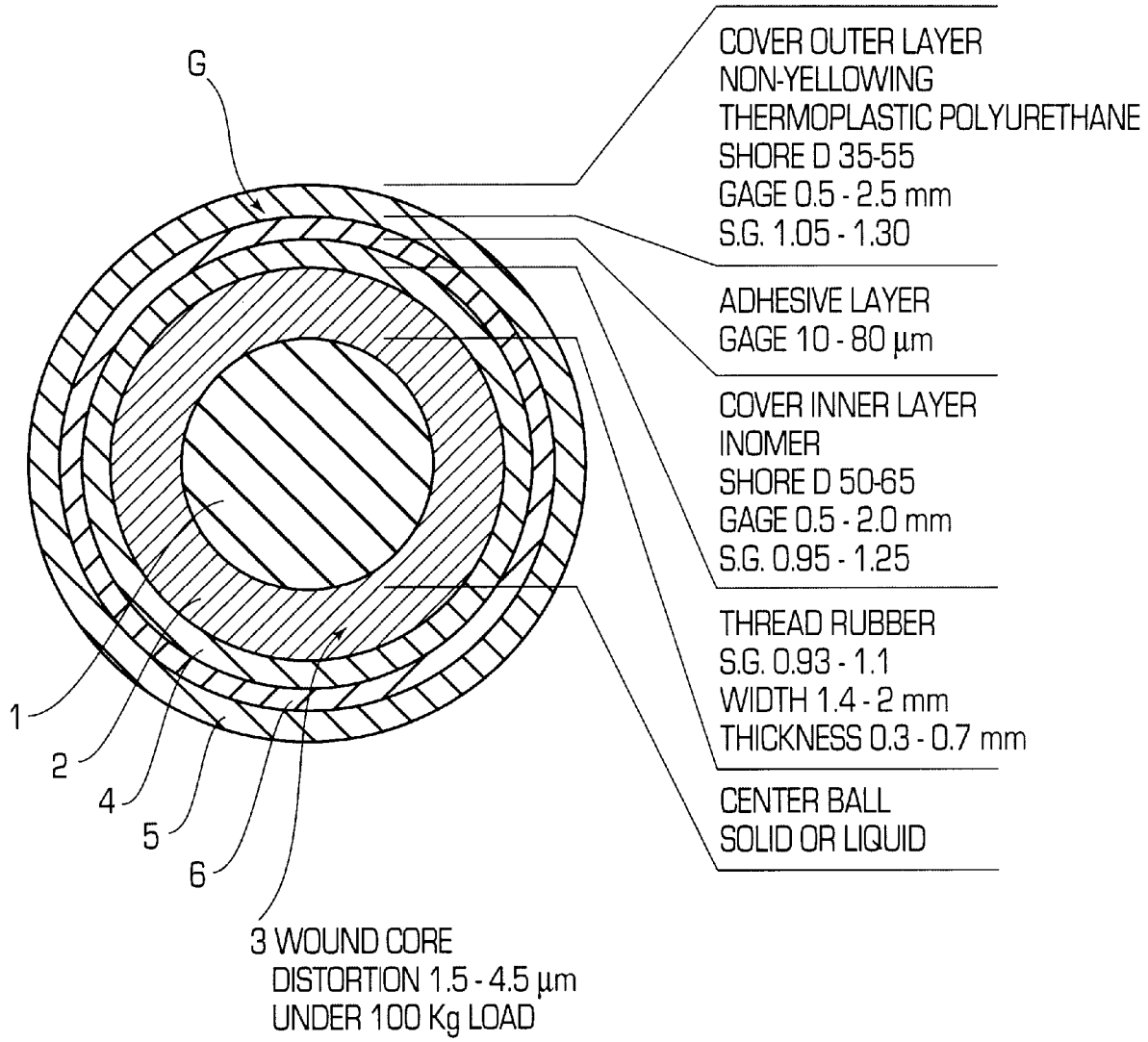
FIG. 1 is a schematic cross-sectional view of one exemplary wound golf ball.

Referring to FIG. 1, a wound golf ball G is illustrated comprising a wound core 3 which is obtained by winding thread rubber around a spherical center ball 1 to form a thread rubber layer 2 thereon. The wound core 3 is enclosed with a cover inner layer 4 and then a cover outer layer 5. According to the invention, an adhesive layer 6 intervenes between the cover inner and outer layers 4 and 5 whereby the cover inner and outer layers 4 and 5 are adhesively joined.

With respect to the materials of the cover inner and outer layers, conventional well-known cover stocks such as ionomer resins and urethane resins may be used. Especially a combination of the cover inner layer of an ionomer resin with the cover outer layer of a non-yellowing thermoplastic polyurethane is advantageous for improving restitution, thereby achieving an increased initial velocity and an increased flight distance.

Appropriate non-yellowing thermoplastic polyurethanes are thermoplastic polyurethane elastomers having an aliphatic diisocyanate, for example, PANDEX T-R3080, T-7298 and T-7890 (trade name, manufactured by Dai-Nihon Ink Chemical Industry K.K.).

More particularly, the thermoplastic polyurethane elastomer has a molecular structure consisting of a high molecular weight polyol compound constituting a soft segment, a monomolecular chain extender constituting a hard segment, and a diisocyanate.

The high molecular weight polyol compound includes polyester polyols, polycarbonate polyols and polyether polyols although it is not limited thereto. Exemplary polyester polyols are polycaprolactone glycol, poly(ethylene-1,4-adipate) glycol, poly(butylene-1,4-adipate) glycol, and poly (diethylene glycol adipate) glycol; an exemplary polycarbonate polyol is (hexane diol-1,6-carbonate) glycol; and an exemplary polyether polyol is polyoxytetramethylene glycol. They have a number average molecular weight of about 600 to about 5,000, preferably about 1,000 to about 3,000.

The diisocyanate used herein is preferably an aliphatic diisocyanate in consideration of the yellowing resistance of the cover. Examples are hexamethylene diisocyanate (HDI), 2,2,4- or 2,4,4-trimethylhexamethylene diisocyanate (TMDI), and lysine diisocyanate (LDI), with the hexamethylene diisocyanate (HDI) being especially preferred.

The chain extenders are not critical and conventional polyhydric alcohols and amines may be used. Examples include 1,4-butylene glycol, 1,2-ethylene glycol, 1,3-propylene glycol, 1,6-hexyl glycol, 1,3-butylene glycol, dicyclohexylmethane diamine (hydrogenated MDA), and isophorone diamine (IPDA).

Another thermoplastic resin may be blended in the thermoplastic polyurethane if desired. Examples of the thermoplastic resin used herein include polyamide elastomers, polyester elastomers, ionomers, styrene block elastomers, hydrogenated butadiene, and ethylene-vinyl acetate copolymers (EVA).

In addition to the above-mentioned resin components, various additives, for example, pigments, dispersants, antioxidants, UV absorbers, and mold release agents may be added to the cover stock in conventional amounts, if necessary.

The hardness and gage of the cover inner and outer layers may be properly determined. Better results are obtained when the cover inner layer has a Shore D hardness of 50 to 65, especially 55 to 65, and a gage of 0.5 to 2.0 mm, especially 1.0 to 1.5 mm, and the cover outer layer has a Shore D hardness of 35 to 55, especially 40 to 50, and a gage of 0.5 to 2.5 mm, especially 1.0 to 2.0 mm. Further preferably, the Shore D hardness of the cover inner layer is higher than that of the cover outer layer, with a hardness difference of at least 10 being recommended. Also preferably, the cover has a total gage of 1.0 to 3.5 mm, especially 1.5 to 3.0 mm. In a further preferred embodiment, the cover inner layer has a specific gravity of 0.95 to 1.25, especially 0.95 to 1.20, and the cover outer layer has a specific gravity of 1.05 to 1.30, especially 1.10 to 1.25.

Each of the cover inner and outer layers is usually formed as a single layer although it may be constructed of two or more plies.

According to the invention, the cover inner layer is disposed around the wound core, the adhesive layer is disposed on the cover inner layer, and the cover outer layer is disposed on the adhesive layer, all in a concentric arrangement.

The adhesive for joining the cover inner and outer layers together is not critical insofar as it can form a firm joint between the two layers. Epoxy resin base adhesives and urethane resin base adhesives are appropriate.

The adhesive is applied to the cover inner layer by any conventional technique, for example, a dispersion coating technique. The gage of the adhesive layer may be suitably chosen although it is usually about 10 to 80 $\mu$m, especially about 20 to 50 $\mu$m. To enhance the bond strength, the surface of the cover inner layer may be finely roughened.

As described above, each of the cover inner and outer layers is constructed of two or more plies if desired. Such two or more plies are optionally joined with an adhesive as used herein.

The wound core is prepared by winding thread rubber around a center ball. The center ball may be either a liquid center consisting of a center bag filled with a liquid or a solid center formed from any well-known rubber compound such as polybutadiene rubber. The material and physical properties of the center ball may be the same as those in conventional well-known wound cores. Usually the solid center is mainly formed of a rubber composition exhibiting a distortion of 1.5 to 4.5 mm under a load of 100 kg. The solid center has a diameter of 28 to 35 mm, especially 30 to 34 mm. The liquid center has a diameter of 26 to 32 mm, especially 28 to 31 mm.

The thread rubber and winding method are also conventional. Although the thread rubber is not limited in specific gravity and size, it preferably has a specific gravity of 0.93 to 1.1, especially 0.93 to 1.0. With respect to the size, the thread rubber preferably has a width of 1.4 to 2.0 mm, especially 1.5 to 1.7 mm, and a thickness of 0.3 to 0.7 mm, especially 0.4 to 0.6 mm.

Like conventional golf balls, the wound golf ball of the invention is formed with a multiplicity of dimples on its surface. The arrangement, diameter, depth and cross-sectional shape of dimples are optimized to increase the moment of inertia for improving the flight distance.

First, the golf ball of the invention is formed with dimples such that, provided that the golf ball is a sphere defining a phantom spherical surface, the proportion of the sum of the surface areas of the phantom spherical surface delimited by the edges of respective dimples relative to the overall surface area of the phantom spherical surface, that is, the percent dimple area occupation is at least 65%, preferably 70 to 80%. With a lower dimple area occupation of less than 65%, an increase of flight distance would not be expected.

Secondly, a percent dimple volume is calculated as (overall dimple volume)/(ball volume)×100%. The ball volume is the volume of a true spherical ball assuming that the golf ball has no dimples in its surface and the overall dimple volume is the sum of the volumes of respective dimples. The percent dimple volume is 0.76 to 1.0%, preferably 0.78 to 0.94%. A percent dimple volume of less than 0.76% would invite a too high trajectory resulting in a shorter carry whereas a percent dimple volume of more than 1.0% would invite a too low trajectory, also resulting in a shorter carry.

The number of dimples is 350 to 500, preferably 370 to 480, more preferably 390 to 450. No particular limit is imposed on the diameter, depth and cross-sectional shape of dimples. Usually the dimples have a diameter of 1.4 to 2.2 mm and a depth of 0.15 to 0.25 mm. The arrangement of dimples is not critical, and any of conventional dimple arrangements such as octahedral, dodecahedral, and icosahedral arrangements may be employed.

While the golf ball of the invention has the above-mentioned construction, it is preferable from the standpoints of durability and hitting feel that the ball hardness is 2.4 to 3.6 mm, especially 2.6 to 3.4 mm as expressed by a distortion under a load of 100 kg.

With respect to weight, diameter and other parameters, the golf ball of the invention should be in accord with the Rules of Golf.

Desirably, the wound golf ball of the invention is prepared by encasing the wound core in a pair of inner layer half cups, effecting compression molding to form a cover inner layer, applying an adhesive to the cover inner layer, drying the adhesive, and injecting molding a cover outer layer thereon. The ball might be prepared by encasing the wound core in a pair of inner layer half cups, effecting compression molding to form a cover inner layer, applying an adhesive to the cover inner layer, drying the adhesive, encasing it in a pair of outer layer half cups, and effecting compression molding to form a cover outer layer; or by applying an adhesive to a pair of inner layer half cups, mating a pair of outer layer half cups therewith, encasing the wound core in a pair of mated half cups, and effecting compression molding. These two methods, however, have the risk that the inner layer material can be squeezed out along the parting line between mold halves during compression molding, resulting in the ball susceptible to cracking by impact at its circumference corresponding to the parting line.

There has been described the wound golf ball in which the cover inner and outer layers are adhesively bonded whereby the ball is improved in restitution, spin and durability.

EXAMPLE

Examples of the invention are given below by way of illustration and not by way of limitation. All parts are by weight.

Examples 1–4 & Comparative Examples 1–3

A center ball was formed as a solid center by mixing core components in accordance with the formulation shown in Table 1 and pressure molding the compound in a conventional manner. Thread rubber of the composition and specifications shown below was wound on the center ball to form a wound core.

TABLE 1

| | | A | B | C | D |
|---|---|---|---|---|---|
| Composition (pbw) | Cis-1,4-polybutadiene rubber | 100.0 | 100.0 | 100.0 | 100.0 |
| | Zinc acrylate | 20.0 | 20.0 | 20.0 | 20.0 |
| | Zinc oxide | 16.5 | 23.0 | 15.0 | 29.5 |
| | Barium sulfate | 17.0 | 21.0 | 15.0 | 30.0 |
| | Dicumyl peroxide | 1.2 | 1.2 | 1.2 | 1.2 |
| Center ball | Outer diameter (mm) | 31.9 | 30.0 | 32.0 | 31.9 |
| as vulcanized | Weight (g) | 21.0 | 17.8 | 20.1 | 23.0 |
| | Specific gravity | 1.22 | 1.26 | 1.18 | 1.35 |
| | Hardness*1 (mm) | 1.95 | 2.10 | 2.00 | 1.85 |

*1a distortion (mm) of the center ball under a load of 100 kg

Thread Rubber

Composition:

| | |
|---|---|
| Polyisoprene rubber | 70 parts |
| Natural Rubber | 30 parts |
| Zinc oxide | 1.5 parts |
| Stearic acid | 1 part |
| Vulcanization promoter | 1.5 parts |
| Sulfur | 1 part |

Specific gravity: 0.93

Size: width 1.55 mm, thickness 0.55 mm

Half cups for the cover inner layer (and optionally, cover outer layer) were prepared by mixing components in a twin-screw extruder in accordance with the formulation shown in Table 2 and molding the cover compositions.

TABLE 2

| | | A | B | C |
|---|---|---|---|---|
| Composition (pbw) | PANDEX T-7298*2 | 100 | — | — |
| | HIMILAN 1706*3 | — | 50 | — |
| | HIMILAN 1605*3 | — | 50 | — |
| | SURLYN 8120*4 | — | — | 100 |
| | Titanium oxide | 5 | 5 | 5 |
| | Magnesium stearate | 0.5 | 0.5 | 0.5 |
| Specific gravity | | 1.18 | 0.97 | 0.97 |
| Shore D hardness | | 42 | 62 | 45 |

*2PANDEX T-7298 is a non-yellowing thermoplastic polyurethane by Dai-Nihon Ink Chemical Industry K.K.

*3HIMILAN 1706 and 1605 are ionomer resins by Mitsui duPont Polychemical K.K.

*4SURLYN 8120 is an ionomer resin by E. I. duPont.

Wound golf balls were prepared by forming covers on the wound cores as follows. The wound golf balls had 392 dimples of three types (percent dimple area occupation 78%, percent dimple volume 0.88%).

In Examples 1 to 4 and Comparative Examples 1 to 2, the wound core was encased in a pair of inner layer half cups, which were compression molded at 145° C. An adhesive was applied to the inner layer and dried. A cover outer layer composition was injection molded thereon.

In Comparative Example 3, the wound core was encased in a pair of inner layer half cups, which were compression molded at 145° C. An adhesive was applied to the inner layer and dried. This was encased in a pair of outer layer half cups, which were compression molded at 145° C.

The adhesive used herein was a two-part curing aqueous urethane adhesive containing a dispersion of an amine-terminated, carboxyl-bearing compound in water as a base and a polycarbodiimide crosslinking agent as a curing agent. The ratio of the base/curing agent/water was 100/5/5 by weight.

The golf balls were evaluated for flight performance and shot durability by the following tests. The results are also shown in Table 3.

Flight Test

Using a swing robot machine (True Temper Co.) and a driver (W#1), the ball was actually hit at a head speed of 45 m/sec. (HS45) to measure a spin rate, initial velocity, elevation angle, carry and total distance.

Durability Test

Using a swing robot machine (True Temper Co.) and a driver, the ball was hit 200 times at a head speed of 45 m/sec. The count of shots causing ball cracking was recorded.

TABLE 3

| | | E1 | E2 | E3 | E4 | CE1 | CE2 | CE3 |
|---|---|---|---|---|---|---|---|---|
| Center ball | Compostion | A | A | A | B | A | D | A |
| | Outer diameter (mm) | 31.9 | 31.9 | 31.9 | 30.0 | 31.9 | 31.9 | 31.9 |
| | Weight (g) | 21.0 | 21.0 | 21.0 | 17.8 | 21.0 | 23.0 | 21.0 |
| | Hardness*5 (mm) | 1.95 | 1.95 | 1.95 | 2.10 | 1.95 | 2.05 | 1.95 |
| | Specific gravity | 1.22 | 1.22 | 1.22 | 1.26 | 1.22 | 1.35 | 1.22 |
| Cover inner layer | Composition | B | B | B | B | B | B | B |
| | Gage (mm) | 0.8 | 1.0 | 0.9 | 1.0 | 0.8 | 1.0 | 1.0 |
| | Shore D hardness | 62 | 62 | 62 | 62 | 62 | 62 | 62 |
| | Specific gravity | 0.97 | 0.97 | 0.97 | 0.97 | 0.97 | 0.97 | 0.97 |
| Adhesive layer | Gage (μm) | 30 | 40 | 30 | 30 | — | — | 30 |
| | Buildup (g) | 0.2 | 0.2 | 0.2 | 0.2 | — | — | 0.2 |
| Cover outer layer | Composition | A | A | A | A | A | C | A |
| | Gage (mm) | 1.8 | 1.8 | 1.4 | 1.8 | 1.8 | 1.8 | 1.8 |
| | Shore D hardness | 48 | 48 | 48 | 48 | 48 | 45 | 48 |
| | Specific gravity | 1.21 | 1.21 | 1.21 | 1.21 | 1.21 | 0.97 | 1.21 |
| | Molding technique | injection | injection | injection | injection | injection | injection | compression |
| Ball | Diameter (mm) | 42.70 | 42.69 | 42.70 | 42.70 | 42.71 | 42.68 | 42.69 |
| | Weight (g) | 45.3 | 45.2 | 45.0 | 45.1 | 45.2 | 45.2 | 45.0 |
| | Hardness*5 (mm) | 2.85 | 2.80 | 2.82 | 2.83 | 2.86 | 2.85 | 2.90 |
| W #1 /HS = 45 | Spin (rpm) | 2850 | 2800 | 2830 | 2930 | 2840 | 2880 | 2800 |
| | Initial velocity (m/s) | 65.5 | 65.5 | 65.7 | 65.6 | 65.5 | 64.7 | 65.3 |
| | Elevation angle (°) | 12.0 | 11.9 | 12.0 | 12.1 | 12.0 | 11.8 | 11.9 |
| | Carry (m) | 205.1 | 205.5 | 206.0 | 206.1 | 204.8 | 201.6 | 205.0 |
| | Total distance (m) | 215.3 | 216.0 | 216.4 | 215.0 | 215.5 | 213.0 | 215.0 |
| Durability | | no crack | no crack | no crack | no crack | cracked at 75 shots | no crack | cracked at 50 shots |

*5a distortion (mm) of the ball under a load of 100 kg

As seen from Table 3, the wound golf balls within the scope of the invention, on driver shots, acquire an increased initial velocity due to high restitution, provide a favorable spin rate, and travel a longer distance. Additionally, they are fully durable against repetitive shots.

In contrast, the wound golf balls having no adhesive layer of Comparative Examples are inferior in all of the tested properties to the inventive balls. More particularly, the wound golf ball of Comparative Example 1 is identical with Example 1 except for the absence of the adhesive layer, and it is susceptible to cracking by repetitive shots, that is, less durable. The wound golf balls of Comparative Examples 2 and 3, in which the cover inner and outer layers are formed of urethane resin and ionomer resin such that the Shore D hardness of the outer layer is lower than that of the inner layer, acquire a lower initial velocity due to poor restitution and travel a shorter distance.

Although some preferred embodiments have been described, many modifications and variations may be made thereto in the light of the above teachings. It is therefore to be understood that within the scope of the appended claims, the invention may be practiced otherwise than as specifically described.

We claim:

1. A wound golf ball comprising; a wound core enclosed with a multilayer cover, the wound core consisting of a center ball and a thread rubber layer thereon, and the multilayer cover including an inner layer and an outer layer, said cover inner layer is formed of an ionomer resin and said cover outer layer is formed of a non-yellowing thermoplastic polyurethane, wherein the multilayer cover further includes an adhesive layer between said cover inner layer and said cover outer layer, said outer cover layer injection molded on said adhesive layer formed on said inner layer.

2. The wound golf ball of claim 1 wherein said cover inner layer has a Shore D hardness of 50 to 65 and a gage of 0.5 to 2.0 mm.

3. The wound golf ball of claim 1 wherein said cover outer layer has a Shore D hardness of 35 to 55 and a gage of 0.5 to 2.5 mm.

4. The wound golf ball of claim 1 wherein said adhesive layer is formed of an epoxy resin or urethane resin base adhesive.

5. The wound golf ball of claim 1, wherein said non-yellowing thermoplastic polyurethane comprises a thermoplastic polyurethane elastomer having an aliphatic diisocyanate.

6. The wound golf ball of claim 1, wherein said cover inner layer has a Shore D hardness in the range of 55 to 65 and a gage in the range of 1.0 to 1.5 mm.

7. The wound golf ball of claim 1, wherein said cover outer layer has a Shore D hardness in the range of 40 to 50 and a gage in the range of 1.0 to 2.0 mm.

8. The wound golf ball of claim 1, wherein said cover inner layer is higher than that of said cover outer layer by at least 10 on the Shore D scale.

9. The wound golf ball of claim 1, wherein said multilayer cover has a total thickness in the range of 1.0 to 3.5 mm.

10. The wound golf ball of claim 1, wherein said cover inner layer has a specific gravity in the range of 0.95 to 1.25.

11. The wound golf ball of claim 1, wherein said cover outer layer has a specific gravity in the range of 1.05 to 1.30.

12. The wound golf ball of claim 1, wherein said adhesive layer has a gage in the range of 10 to 80 $\mu$m.

13. The wound golf ball of claim 1, wherein said center ball of said wound core is formed of a rubber composition having a distortion of 1.5 to 4.5 mm under a load of 100 kg.

14. The wound golf ball of claim 1, wherein said thread rubber forming said thread rubber layer has a specific gravity in the range of 0.93 to 1.1, a width of 1.4 to 2 mm and a thickness of 0.3 to 0.7 mm.

* * * * *